US010568397B2

(12) United States Patent
Despain

(10) Patent No.: US 10,568,397 B2
(45) Date of Patent: Feb. 25, 2020

(54) MINIMALIST WALLET APPARATUS AND METHOD

(71) Applicant: FIREBOX OUTDOORS, LLP, Moroni, UT (US)

(72) Inventor: Steven S. Despain, Orem, UT (US)

(73) Assignee: Firebox Outdoors LLP, Moroni, UT (US)

( * ) Notice: Subject to any disclaimer, the term of this patent is extended or adjusted under 35 U.S.C. 154(b) by 0 days.

(21) Appl. No.: 15/792,240

(22) Filed: Oct. 24, 2017

(65) Prior Publication Data

US 2018/0116352 A1 May 3, 2018

Related U.S. Application Data

(60) Provisional application No. 62/413,674, filed on Oct. 27, 2016.

(51) Int. Cl.
*A45C 1/06* (2006.01)
*A45C 11/18* (2006.01)

(52) U.S. Cl.
CPC ..... *A45C 1/06* (2013.01); *A45C 11/182* (2013.01)

(58) Field of Classification Search
CPC ..... A45C 1/06; A45C 11/182; B65D 27/08
USPC ..... 150/131, 149, 132, 130; 229/84, 87.03, 229/928; 206/37, 39
See application file for complete search history.

(56) References Cited

U.S. PATENT DOCUMENTS 489,125 A * 1/1893 Knight
724,237 A * 3/1903 Armstrong
1,042,488 A * 10/1912 Shaffer ..... B42F 7/08 229/67.3
1,865,881 A * 7/1932 Ottinger ..... A45C 1/08 150/132
2,031,773 A * 2/1936 Halperin ..... A45C 1/00 150/137
2,405,914 A * 8/1946 Van Rosen ..... B65D 5/10 229/117.24
3,635,392 A * 1/1972 Burgher ..... B65D 27/06 206/216
3,966,113 A * 6/1976 Tipton ..... B65D 5/18 229/149
4,153,091 A * 5/1979 Jahn ..... B65D 33/24 206/265
4,221,161 A * 9/1980 Hurt ..... B65D 27/08 229/72
4,671,332 A * 6/1987 McPhee ..... A45C 1/06 150/132

(Continued)

*Primary Examiner* — Sue A Weaver
(74) *Attorney, Agent, or Firm* — Brake Hughes Bellermann LLP

(57) ABSTRACT

A minimalist wallet provides capture and ready access to credit cards, paper money bills, and receipts in a single (solitary; one and only one) pocket covered by a closure acting as a guide to fold money and receipts. Credit cards act as a bender or edge around which to bend bills and receipts. The closure tucks into the pocket and the entire wallet fits within a shirt pocket, a front or rear trouser pocket, or in a jacket, sweater, or the like with minimum profile. Relieved corners (open corners; non-corners) permit the wallet to thin down to minimum content or expand to maximum content. The wallet is simple, adaptable, renders all the content readily visible, yet secures all contents so long as it remains within any pocket of clothing or luggage.

20 Claims, 13 Drawing Sheets

(56) References Cited

U.S. PATENT DOCUMENTS

| | | | | |
|---|---|---|---|---|
| 6,112,961 | A * | 9/2000 | Phillips | A45C 1/04 150/131 |
| 6,811,025 | B1 * | 11/2004 | Kaplan | A45C 11/18 150/144 |
| 6,889,836 | B2 * | 5/2005 | Colloton | B65D 5/64 206/425 |
| 2004/0103500 | A1 * | 6/2004 | Ward | A45C 1/06 24/17 B |
| 2005/0076979 | A1 * | 4/2005 | Hyrman, Sr. | A45C 1/06 150/132 |
| 2011/0303331 | A1 * | 12/2011 | Laake | A45C 1/06 150/131 |
| 2019/0054754 | A1 * | 2/2019 | Peredo | B42D 5/025 |

* cited by examiner

MINIMALIST WALLET APPARATUS AND METHOD

RELATED APPLICATIONS

This application claims the benefit of U.S. Provisional Patent Application Ser. No. 62/413,674, filed Oct. 27, 2016, which is hereby incorporated by reference.

BACKGROUND

Field of the Invention

This invention relates to containers and, more particularly, to novel systems and methods for pocket-sized wallets.

Background Art

Purses, wallets, handbags, clutches, pocketbooks, and the like are ubiquitous. Pockets, purses, scrips, money belts, and the like date from ancient times. They may be coincident with the creation of money as a token system.

Wallets are not only uncomfortable to sit on when placed in a rear pocket of a pair of trousers, but can actually be physically damaging to spinal alignment, proper alignment between spine and hip bones, and so forth. Medical complications due to exactly such phenomena have been document in the professional literature.

Wallets of conventional types are typically configured to be carried in a front breast pocket of a suit coat, in a rear pocket of trousers, or in a purse. Typically, they have many features, pockets, specialized slots or retainers, and the like. One reason justifying all these "compartments" is organization: A place for everything and everything in its place. Another is access. One typically wants to find a specific item without pawing through a pile of unrelated "stuff."

The mechanical result of the foregoing is a comparatively large, heavy, complex, thick system demanding its own accommodation whenever an individual decides to carry it. In an effort to simplify wallets, and create a system for storing necessary paper money, coins, photographs, credit cards, business cards, and the like, wallets start to appear like the proverbial utility belt for a superhero.

It would be an advance in the art to create a wallet that is the antithesis of heavy bulky wallets. It would be an advance to create for such a wallet an organizational scheme that is effective yet simple. It would be a further advance to develop a wall and organizational scheme making contents readily available for viewing, removing, and inserting.

Such a system should be comparatively light weight, small in all dimensions, including thicknesses of materials, not wasteful of space, and yet able to fit paper bills (paper money, legal tender in paper bills), credit cards, and receipts (records, especially records of financial transactions) in a convenient format. Likewise, ready access, removal of contents, replacement of receipts or change, into the wallet, and the like, individually and together would advantageous.

BRIEF SUMMARY OF THE INVENTION

In view of the foregoing, in accordance with the invention as embodied and broadly described herein, a method and apparatus are disclosed in certain embodiments in accordance with the present invention as including a minimalist wallet. The apparatus and method provide capture and ready access to credit cards, paper money bills, and receipts in a single pocket (one and only one, although other embodiments could add layers to create pockets) covered by a closure acting as a guide to fold money, receipts, either one alone, or both together. Credit cards act as a bender or edge around which to bend bills. Receipts may be folded and placed behind bills, or stacked and folded with bills.

The closure tucks into the pocket and the entire wallet fits within a shirt pocket, a front or rear trouser pocket, or in a jacket, sweater, or the like with minimum profile. Relieved corners permit the wallet to thin down to minimum content or expand to maximum content. The wallet is simple, adaptable, renders all the content readily visible, yet secures all content so long as it remains within any pocket of clothing or luggage of a user.

A method for forming a wallet may include forming a single piece of material into a predetermined shape accommodating corners, folds, and securement portions for the wallet. Side walls establish a perimeter of a pocket for the wallet with seaming of the side walls to at least one of a front portion, and a back portion, and each other to form the pocket. A closure is integral to the pocket, having an extreme end, foldable into the pocket to enclose contents of the pocket on at least four sides. The closure may tuck into the pocket to substantially enclose the contents of the pocket on six sides, and slip out by pulling or sliding under thumb pressure to expose and lay out contents.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
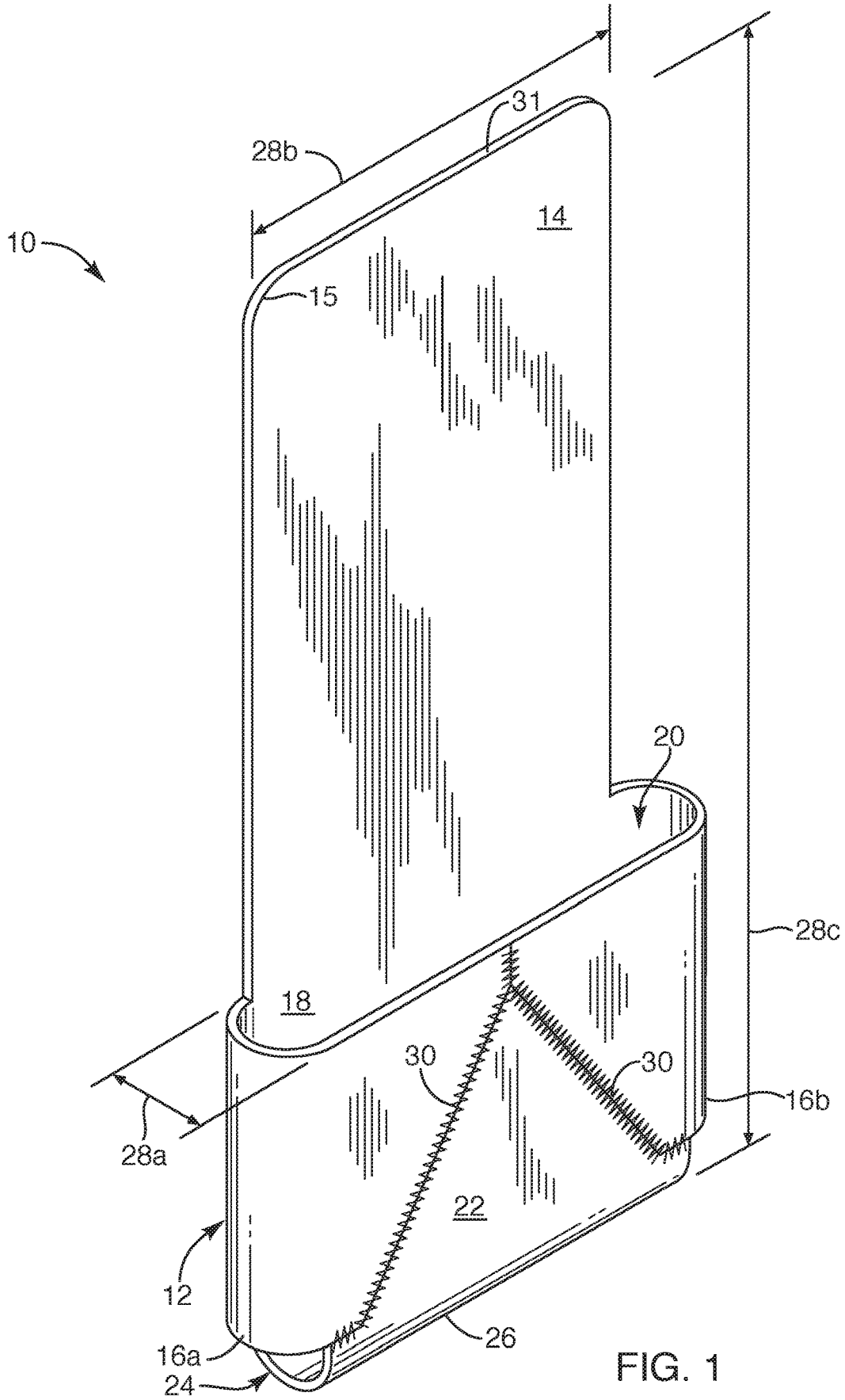
FIG. 1 is a frontal perspective view of one embodiment of an apparatus in accordance with the invention in an open position.
Figure 2:
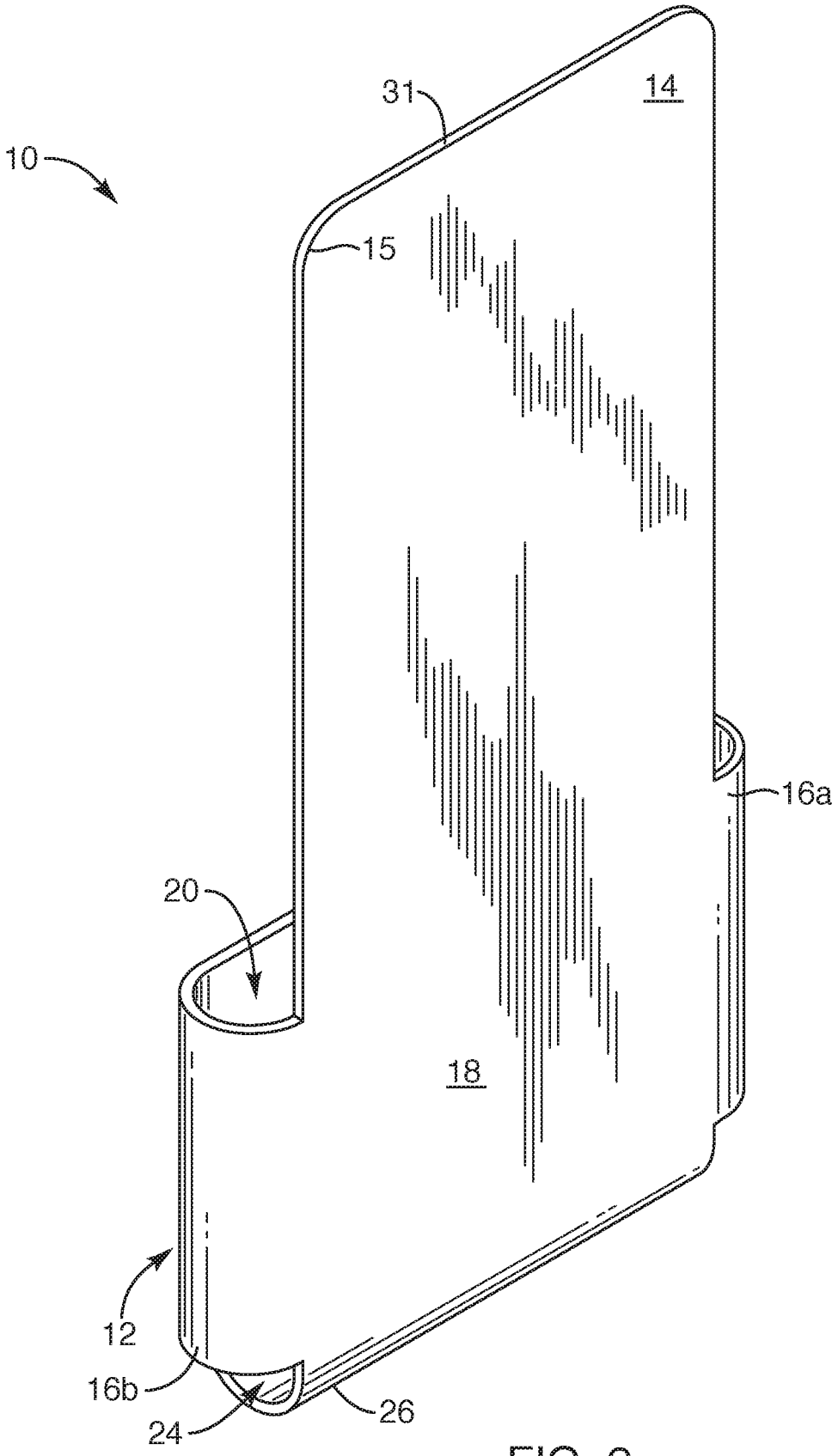
FIG. 2 is a rear perspective view thereof.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIGS. 1 through 10, while referring generally to FIGS. 1 through 20, a wallet 10 in accordance with the invention may include a pocket 12 or pocket portion 12. It may be formed of one or more pre-determined shapes (e.g., "blanks,") of sheet material pre-cut, folded, and bound or otherwise secured together.

In one presently contemplated embodiment, the entire wallet 10 is formed of a single piece (blank) of material. That material may be a fabric (woven or non-woven), such as cotton, polyester, polypropylene, nylon, linen, bamboo, other natural or synthetic fiber, or a solid sheet. Fibers may be formed into a felt, broadcloth weave, knit fabric, canvas, hopsack material, or bonded, non-woven fabric.

Material may be thick (e.g., Cordura™ ballistic nylon or backpack material, silicone, expanded polyethylene, expanded polyurethane, etc.), thin (percale, linen, plastic, MYLAR™ film, or the like), or in some way calculated to provide sufficient strength, durability, flexibility, in-plane stiffness, out-of-plane bending, and similar properties to serve as a wallet 10.

In the illustrated embodiment, the wallet 10 may include a closure 14. The closure 14 may also be referred to as a tongue 14 and operates to tuck in around and contain (e.g., trap, secure, etc.) the content of the wallet 10 inside the pocket 12. Meanwhile, the closure 14 also has the responsibility to easily open with application of a force sliding the closure 14 upward out of the pocket 12. This is accomplished in part by a choice of materials, and partly by an opening technique.

Opening force may occur by application of pressure against contents and friction upward at the surface of the closure 14. Friction may also be transferred by the closure 14 against the bills or other paper as well. These may be done by sliding with a pressure against and push upward by a thumb on the closure.

It may occur by pushing up with a thumb on the closure and down with fingers on the back of the wallet 10, squeezed between the two. It may occur with a grip of the closure 14 between a thumb and fingers, in order to push or draw the closure 14 out of the pocket 12. A single opening motion presents the contents all readily visible and accessible to a user.

Referring to FIGS. 11 through 20, while continuing to refer generally to FIGS. 1 through 20, the wallet 10 may fold down into a comparatively compact overall size. For example, when the closure 14 has been tucked into the pocket 12, the wallet 10 may be comparatively compact in all dimensions. However, dimensions are literally flexible in all directions of the wallet 10 itself.

For example, if minimal content is contained within the wallet 10, the wallet 10 and content 38 may crush together for a very thin overall thickness, but enlarged width and length as the side walls 16 fold in the middle. Meanwhile, if the content 38 is considerably more voluminous, then the pocket 12 may expand to an overall maximum wallet 10 thickness substantially larger and limited only by the available width dimensions of the walls 16.

Referring to FIGS. 1 through 20, the pocket 12 may be formed by a side wall 16, or side wall portion 16 enclosing the pocket 12 from a back portion 18 around an upper aperture 20 or simply an opening 20 to connect to a front 22 or a front portion 22. Thus, the pocket 12, its closure 14 extending from a back portion up and over the top thereof, folds down behind the front portion 22.

An optional corner 15 on the closure may be of any suitable shape, typically effective to pilot (e.g., lead, direct, urge, orient, guide, etc.) the closure 14 into the pocket 12. A left side wall 16*a* and right side wall 16*b* extend between and connect the back 18 or back portion 18 and the front 22 or front portion 22. A floor 26 or bottom wall 26 extends between the back 18 and the front 22 below the side walls 16.

Having a closed corner at the bottom 26 would include either the front and back flat together like two sheets, or the front 22, back 18, and walls 16, 26 as a box corner. Either must create a less adaptable shape, one thin with large edge spaces, the other thick and less compactible in shape. Gusseted or otherwise selectively expandable configurations involve more material, weight, and unruly opening and closing.

Here, the pocket 12 may have a relief 24 or opening 24. This open corner 24 eliminates the need for a closed corner of any type connecting the side walls 16 to the floor 26 at the bottom of the pocket 12.

For example, in the illustrated embodiment, the floor 26 extends between and connects along the bottom 26 of the pocket 12 between the back 18 and the front 22. However, the back panel 18 and front panel 22 may actually be formed of one homogeneous (same, uniform) continuous (unbroken, connected) material with respect to the floor 26. In a molded shape, the sides 16 may be homogeneous and contiguous as well.

By any means, the relief 24 is provided where a corner should or would otherwise connect the side walls 16 to the floor 26 and the front 22 and the back 18. This structure assures that the front 22 and back 18 may expand as far apart as the dimension of the side walls 16 will permit. Meanwhile, with minimal content inside, the back 18 and front 22 may approach one another without restriction, even to an empty condition, where they are in full contact.

On the other hand, when full of contents, the front 22 and back 18 are free to separate to the maximum degree permitted by the side walls 16 and the floor 26. In the limit, the relief corner 24 may devolve to a veritable slit as the floor 26 and side walls 16 extend to their maximum widths (in the direction of thickness of the wallet 10). No corner construction need exist in the wallet 10 to bind the floor 26, the front 22, the back 18, and the side walls 16 together. To do so would result in a bulky, stiff, or complex structure near the bottom corner edge of the floor 26.

Figure 3:
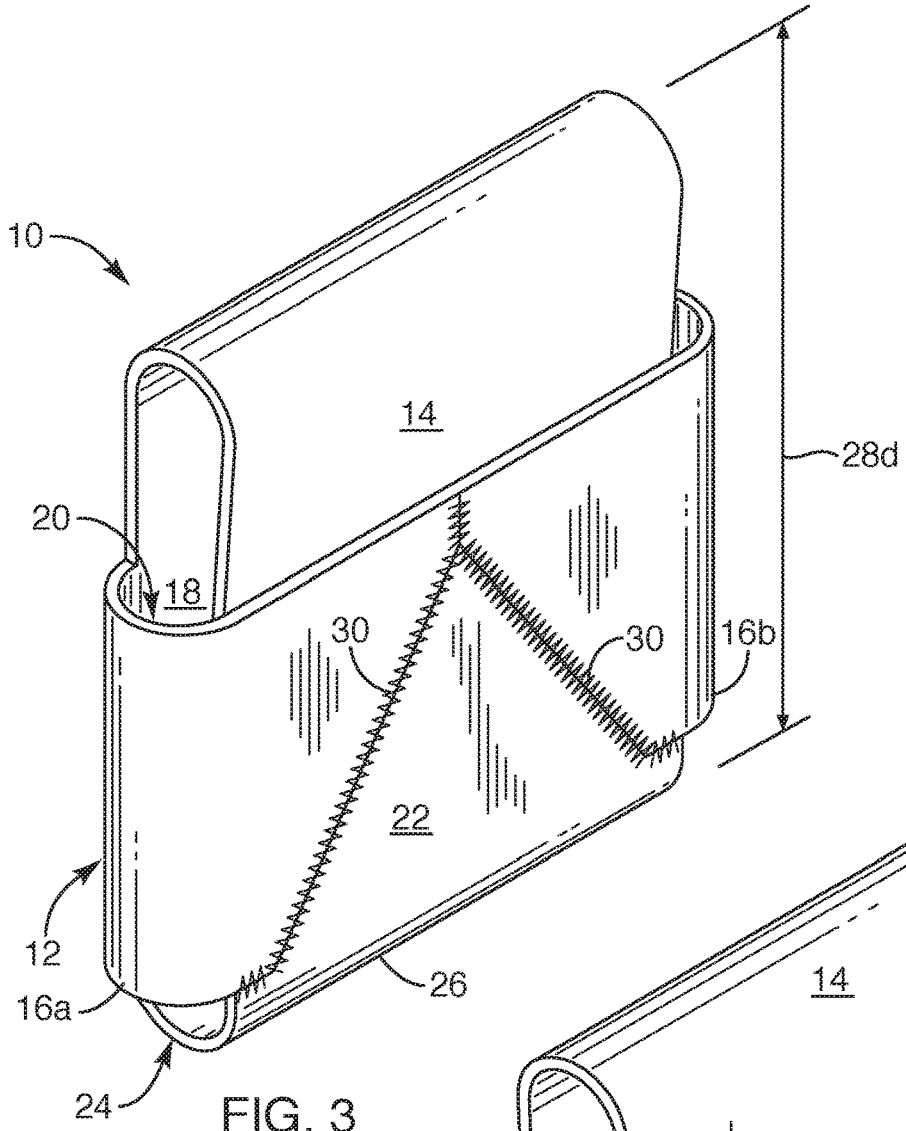
FIG. 3 is a frontal perspective view of a wallet in accordance with the invention in a closed configuration.
Figure 4:
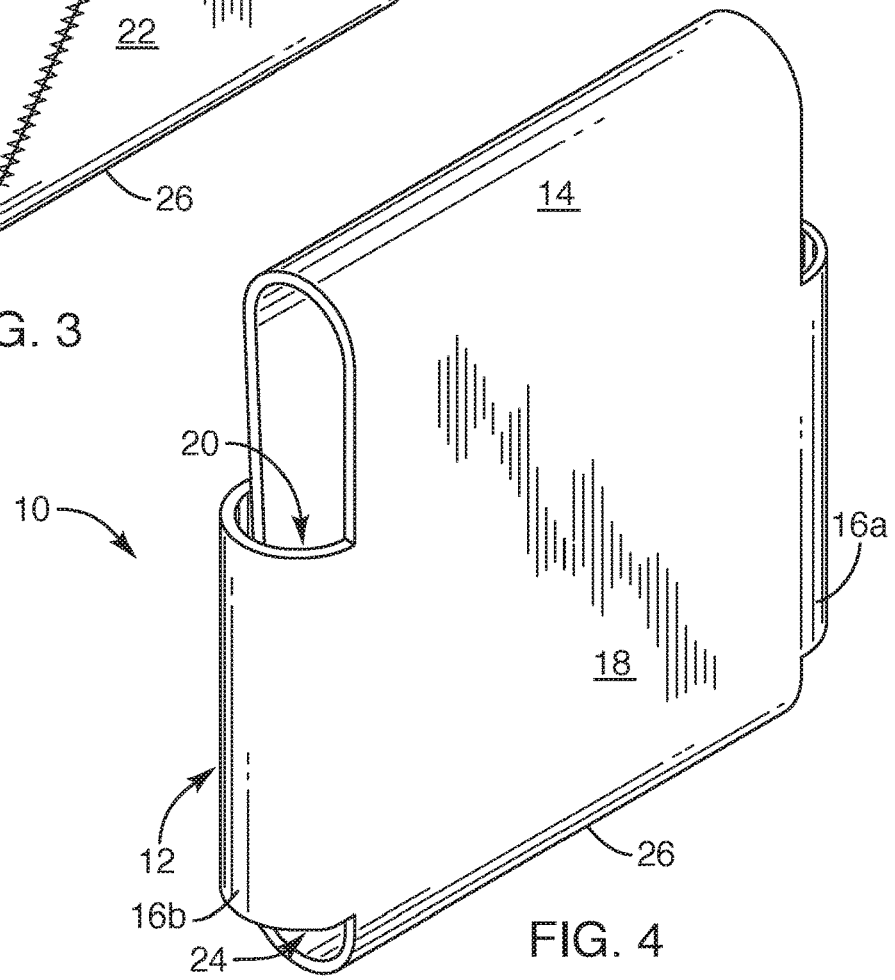
FIG. 4 is a rear perspective view thereof.
Figure 5:
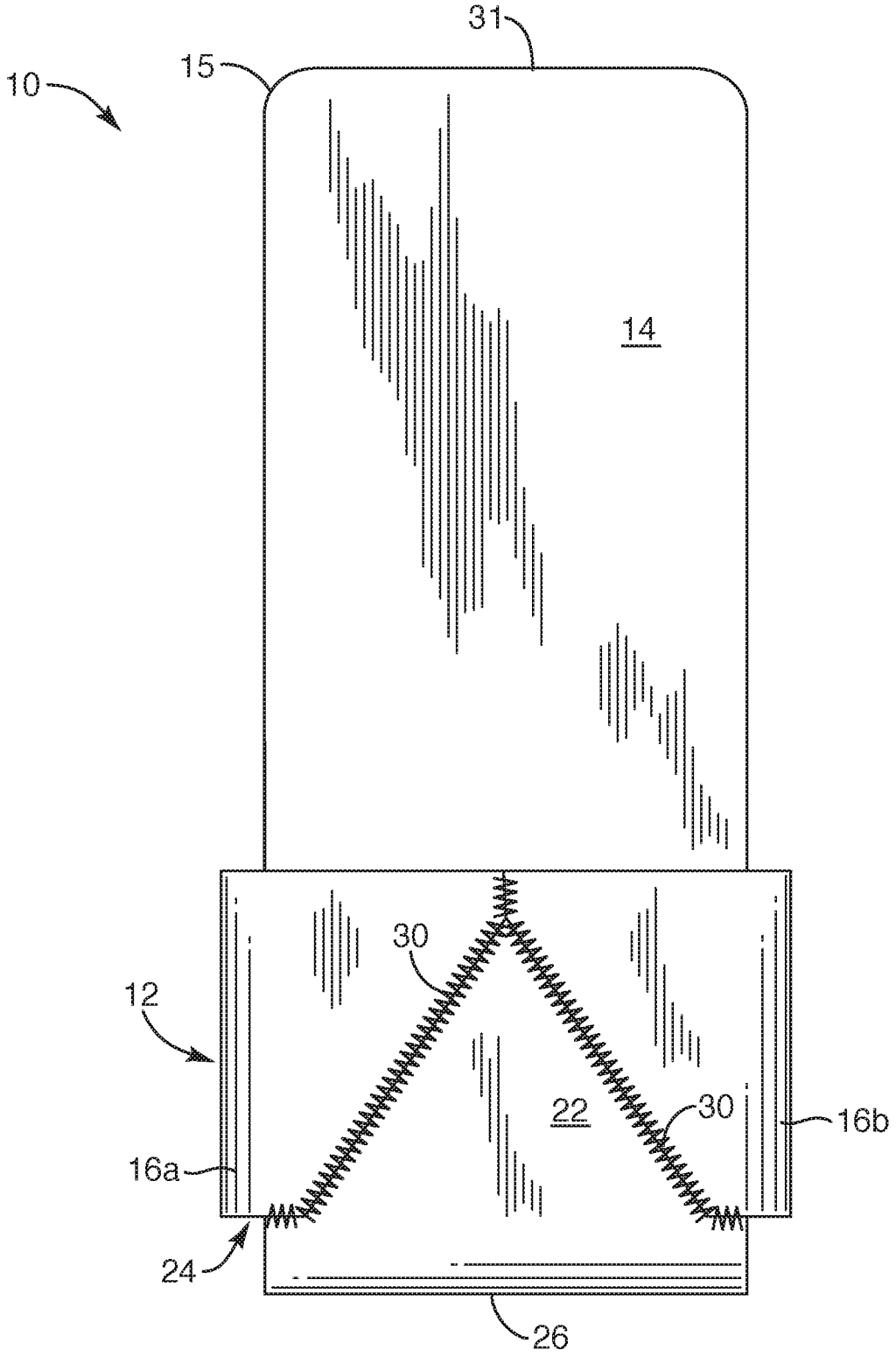
FIG. 5 is a front elevation view of the wall in an open configuration.
Figure 6:
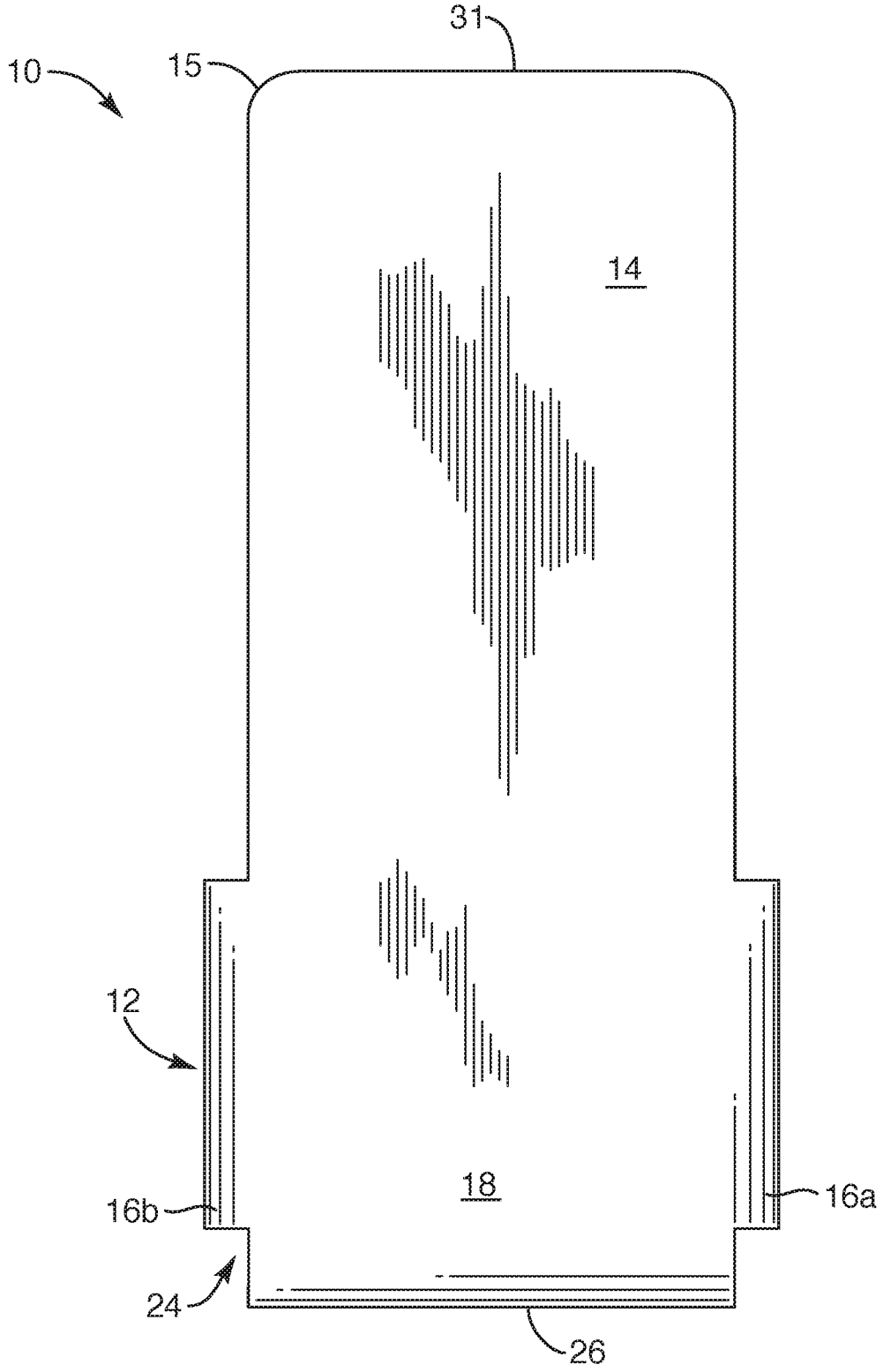
FIG. 6 is a rear elevation view thereof.
Figure 7:
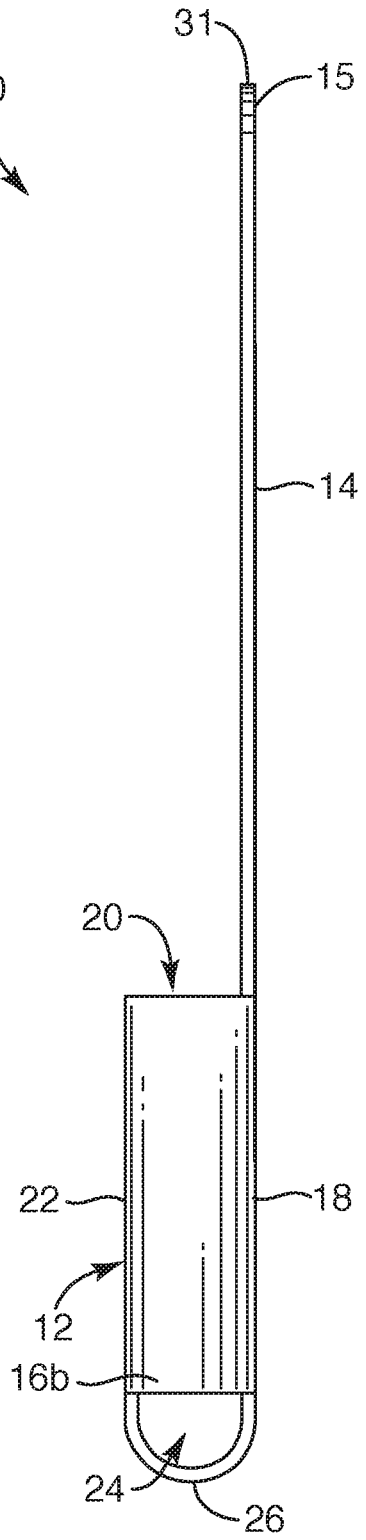
FIG. 7 is a right side elevation view thereof.
Figure 8:
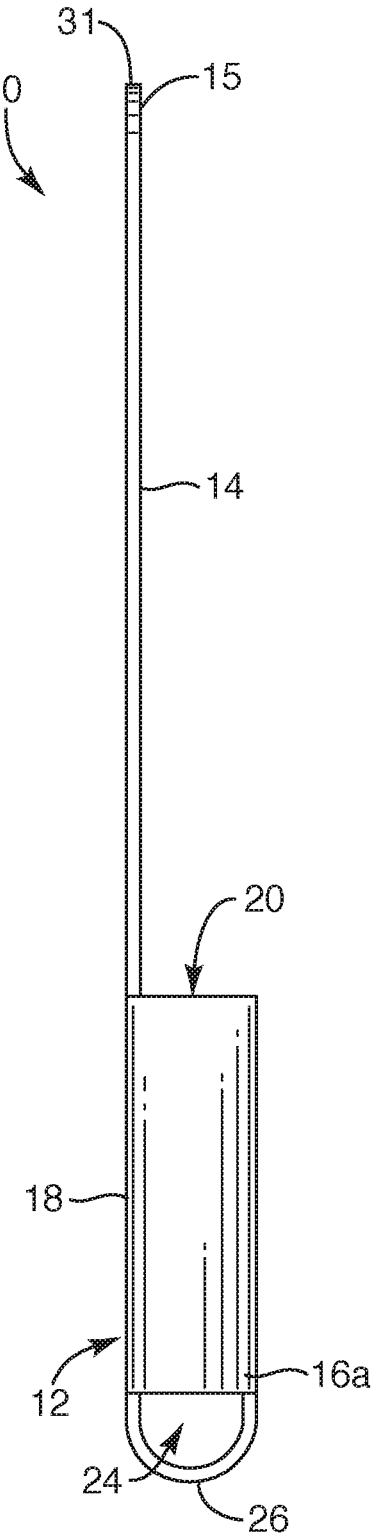
FIG. 8 is a left side elevation view thereof.
Figure 9:
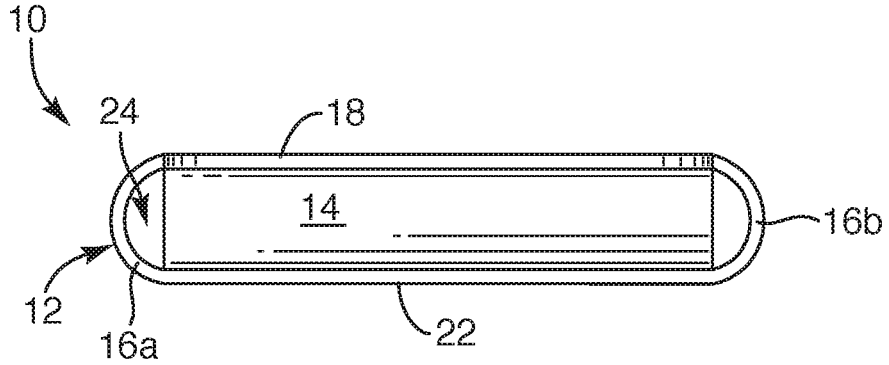
FIG. 9 is a top plan view thereof.
Figure 10:
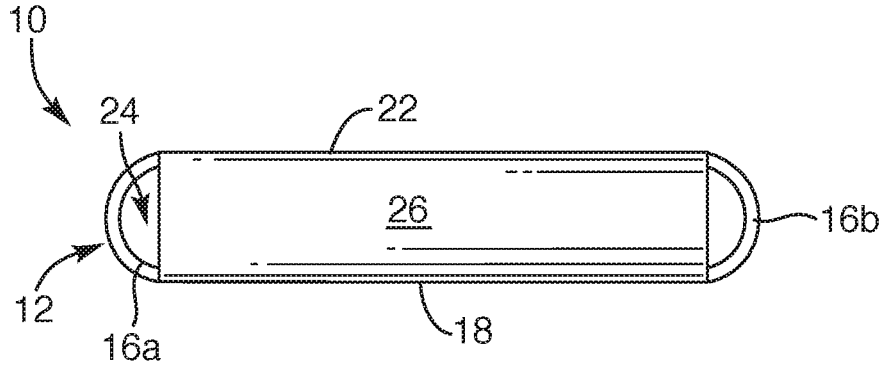
FIG. 10 is a bottom plan view thereof.
Figure 11:
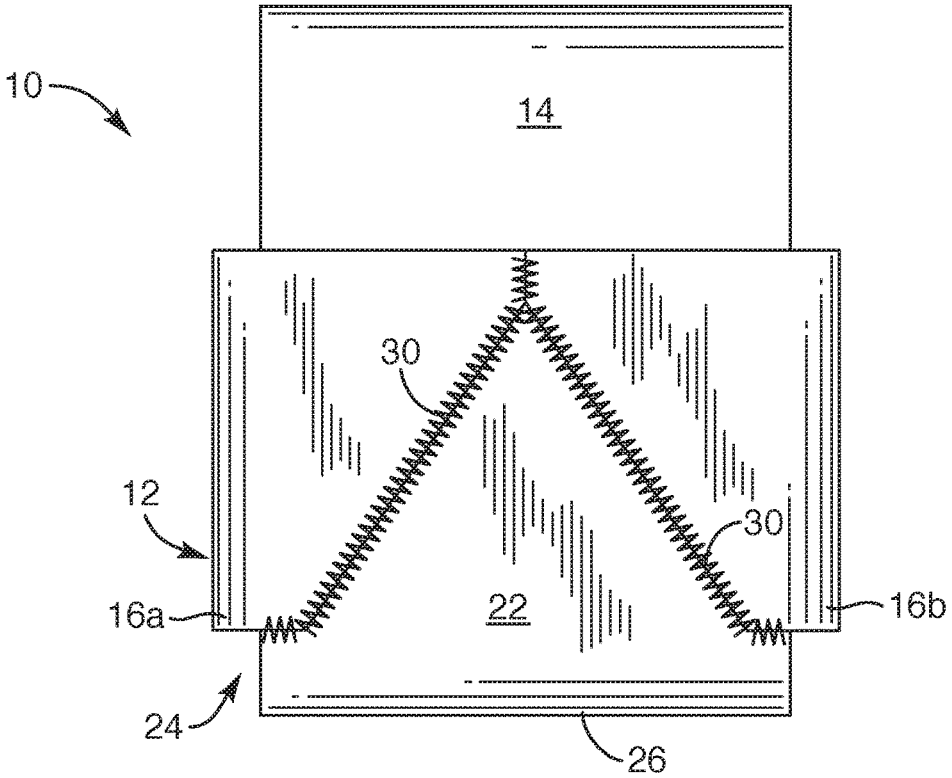
FIG. 11 is a front elevation view of a wallet in accordance with the invention in a closed configuration.
Figure 12:
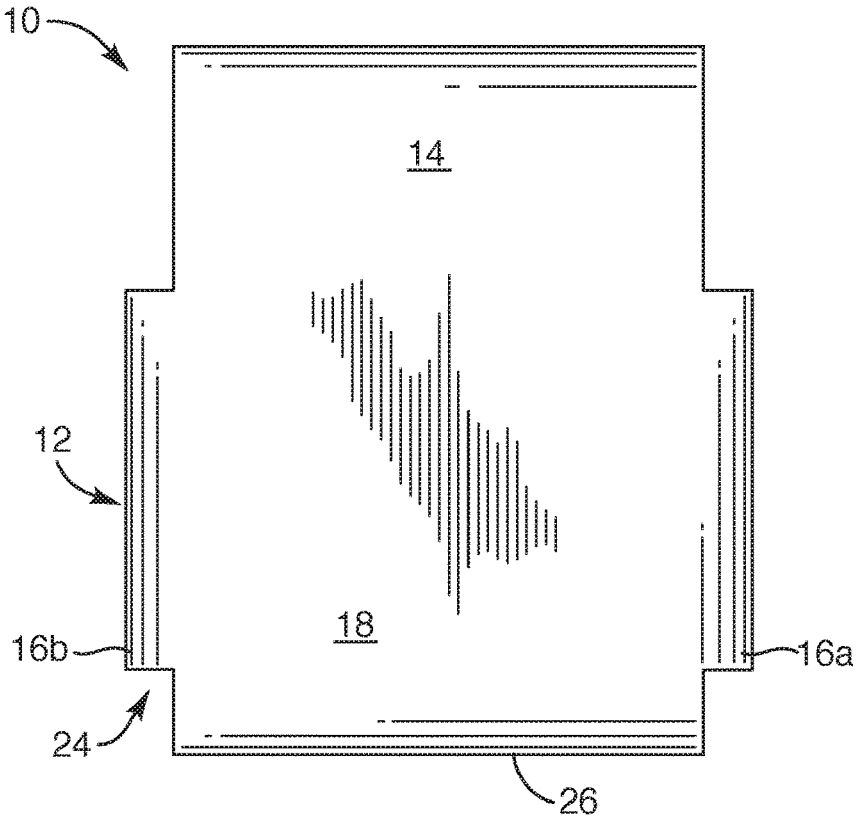
FIG. 12 is a rear elevation view thereof.
Figure 13:
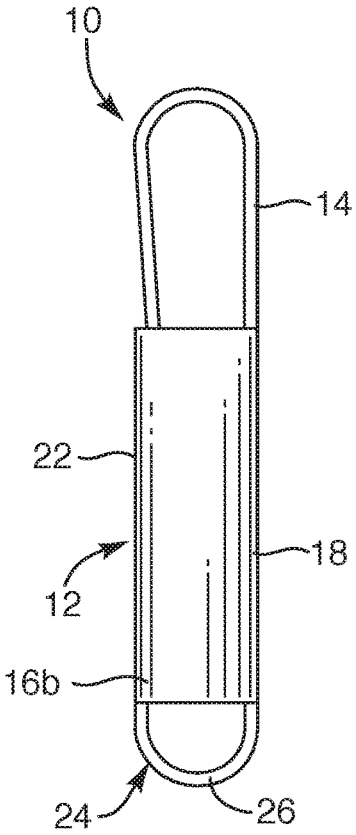
FIG. 13 is a right side elevation view thereof.
Figure 14:
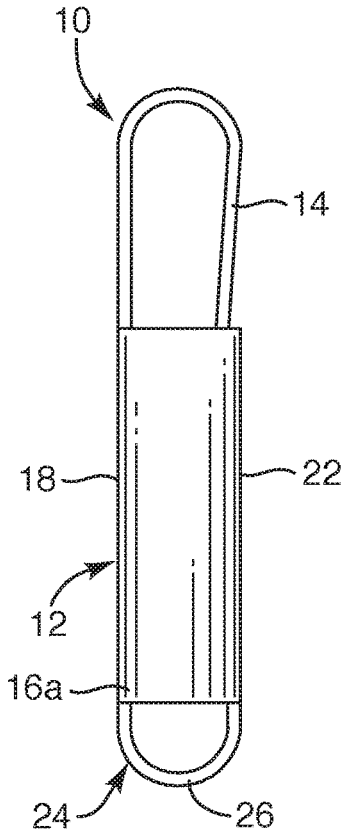
FIG. 14 is a left side elevation view thereof.
Figure 15:
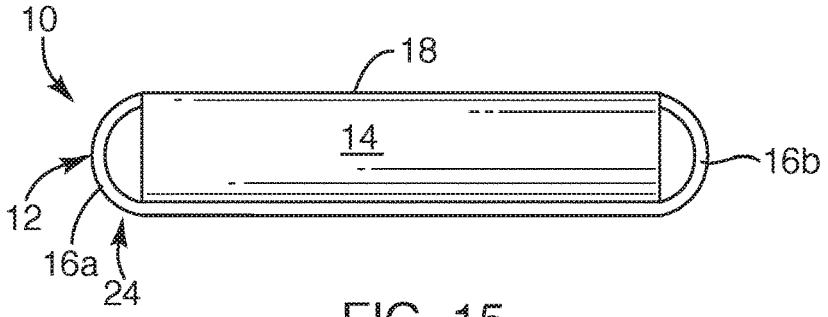
FIG. 15 is a top plan view thereof.
Figure 16:
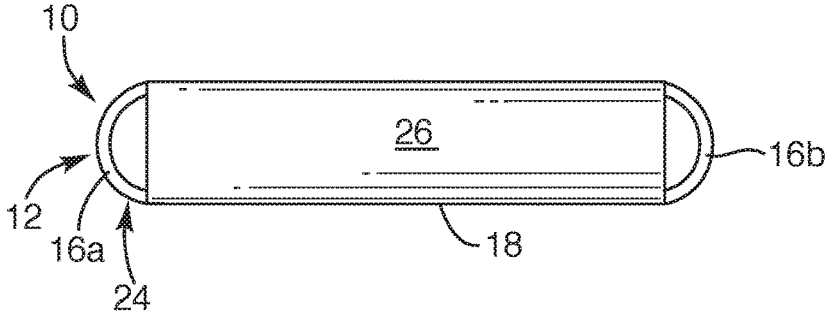
FIG. 16 is a bottom plan view thereof.

For example, in FIG. 1 are illustrated the dimensions 28*a*, 28*b*, 28*c*. Likewise, in FIG. 3 is illustrated a dimension 28*d*. As illustrated, a thickness 28*a* of the wallet (which, at its maximum extent, is the width 28*a* of each wall 16, 26) is adjustable when not full. Deflection of the side walls 16 and floor 26 (e.g., by bending, folding) permits the front 22 and back 18 to approach one another.

Herein, any reference numeral refers to a particular item, like the floor 26 or any side wall 16*b*. Any trailing letter following a reference numeral simply references a particular instance of the item identified by the reference numeral, like side wall 16*a*, or wall 16*b*. Accordingly, herein, it is proper to speak of any reference numeral or item identified by reference numeral and trailing alphabetical character by either the reference numeral or the reference numeral and a trailing letter. It is to be understood that the reference to a reference numeral includes reference to any or all the uses of the reference numeral having trailing letters.

Referring to FIGS. 1 through 10, and FIGS. 1 through 20 generally, the seams 30 may be used to secure edges of various portions of the wallet 10 together. In the illustrated embodiment, the seam 30 is shown as a zig-zag style by which abutted edges of the base material may be secured together with substantially no increase in thickness.

For example, if the base material of the wallet 10 is leather, a tightly sewn seam 30 will typically remain entirely or almost entirely below the outermost surface and thus provide a substantially flush front 22 in spite of the presence of the seam 30.

Of course, other mechanisms or methods for adding seams 30 may be used, including overlapping, inverted, heat-welded, or the like. For example, if a synthetic fiber fabric forms the material of the wallet 10, heat sealing may provide a simple mechanism for seaming edges together. These may be abutted (edge to edge), overlapped (surface on surface), interlocked (folded back 180 degrees, surface-to-surface), or the like as known in the art of sewing.

An "open" configuration or condition is illustrated in FIGS. 1 through 10. The pocket 12 in the illustration has a back 18 that simply continues the back 18. The closure 14 is a continuation of the same material, seamless and continuing up above the opening 20 at the top of the pocket 12 to form the closure 14. The closure 14 here also serves the purpose of presenting and stabilizing paper money 34 (e.g., bills 34) contained in the pocket 12.

For example, due to continuous use with comparatively small content 38, the thickness 28*a* may become comparatively thin. Accordingly, the side walls 16 may affectively collapse against themselves, as the front 22 and back 18 approach one another. Thus, the overall width 28*b* may expand, and the length 28*d* expand while the bottom 26 collapses as well, when the wallet 10 is flattened to a comparatively "empty" thickness 28*a*. Meanwhile, the overall thickness 28*a* may expand as the width 28*b* and length contract to provide the side walls 16 extending a maximum distance between the front 22 and the back 18.

In the open position illustrated, the length 28*c* may extend from the floor 26 to an upper edge 31 of the closure 14. Thickness 28*a* and width 28*b* will comply with contents 38.

Referring to FIGS. 11 through 20, a wallet 10 in accordance with the invention in a closed configuration may include folding the edge 31 of the closure 14 downward and back against the content of the wallet 10. Sliding the edge 31 along with its content 38 down into the aperture 20 or opening 20 that accesses the pocket 12.

Figure 17:
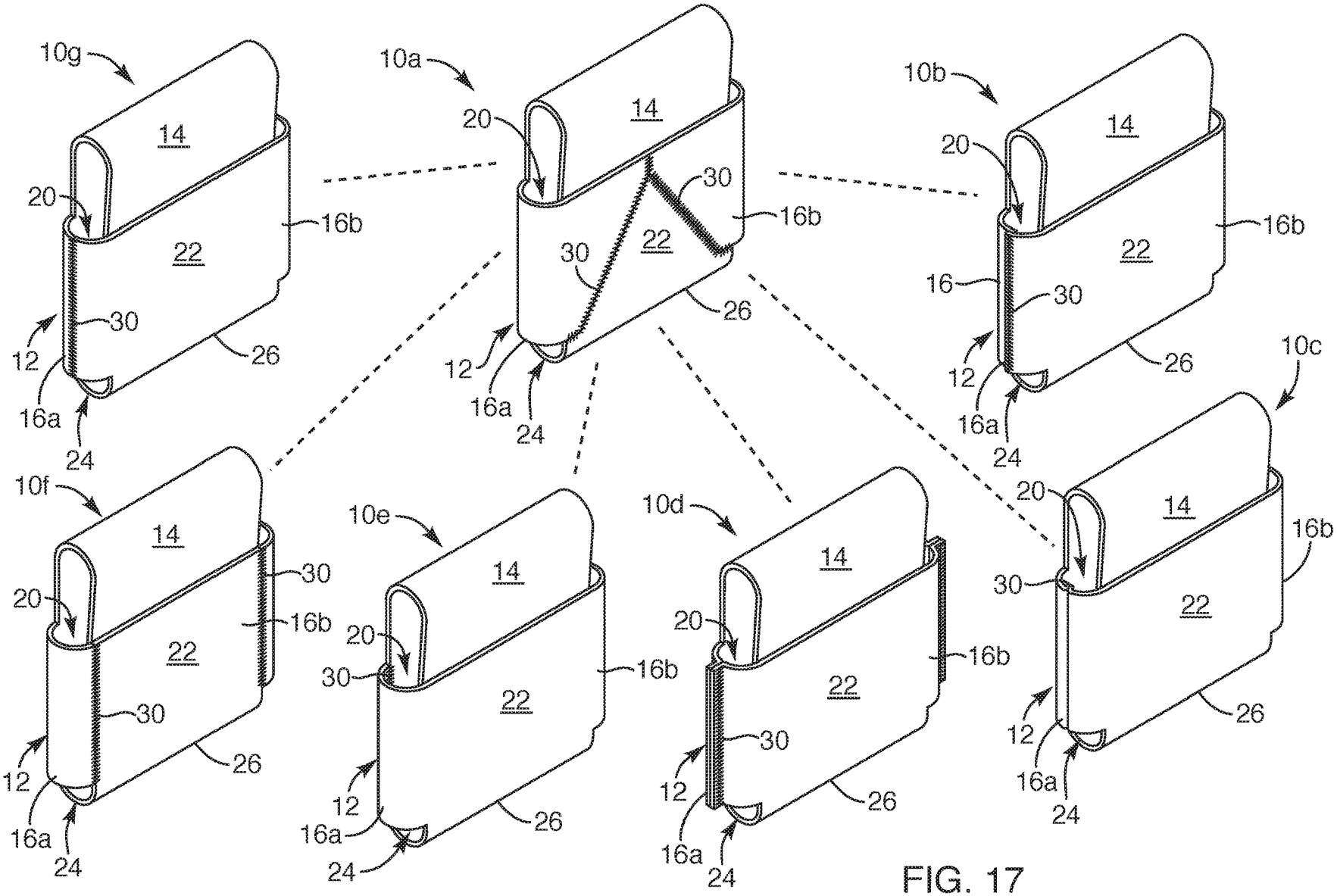
FIG. 17 is a perspective view of various alternative embodiments of seams applied to a wallet in accordance with the invention.

Referring to FIG. 17, while continuing to refer generally to FIGS. 1 through 20, various embodiments of sewing may be used. In fact, sewing may be replaced by heat sealing, heat seaming, or any other suitable fastener. In certain embodiments, rivets and the like may even be used.

Nevertheless, it has been found that sewing a seam 30 securing together abutted edges of various portions 16, 18, 22, 26 of the wallet 10 permits maximum expansion as content is increased, yet minimal thickness 28*a* upon flattening or thinning to accommodate reduced content, and easy access to the content 38 by a user.

In the illustrated embodiment of the wallet 10*a*, the seams 30 sew together abutting edges of material extending from the right and left side walls 16, as well as from the floor 26. Together, these extensions of the side walls 16 and floor 26 form the front 22 of the wallet 10.

In contrast, the seam 30 of the wallet 10*b* relies on overlapping portions of the side wall 16. In fact, the stitch 30 need not be zig-zagged in this embodiment, because there is no need to hold two abutting edges together. Rather, overlapped edges may use a typical straight seam, multiple straight seams, or the like. One will note, however, that the side walls 16 of the wallet 10*a* do not add the bulk and stiffness of a double layer near the seam 30 as in the wallet 10*b*. Thus, the wallet 10*a* collapses more easily and more completely (thinner, for a same material).

Similarly, the wallet 10*c* may have a conventional inverted seam, wherein the seam 30 is first sewn, securing the edges of the side walls 16*a*, 16*b* together with respect to themselves. Thereafter, the pocket 12 may be inverted (turned inside out) to effectively hide the seam and create a more pleasant outer profile. Nevertheless, such a seam 30 necessarily adds to the bulk of the wallet 10*c*.

The wallet 10*d* may effectively be an equivalent of the wallet 10*c* not inverted. For example, a flat seam 30 may be sewn into each side wall 16*a*, 16*b*. In this embodiment, width 28*b* is necessarily wider. The material of the wallet 10*d* in some embodiments may be particularly stiff, such as certain leathers, certain polymers, plastic film, or the like. The default or equilibrium position of the front 22 and the back 18 may be adjacent one another in the absence of content. Thickness 28*a* and width 28*b* may vary inversely between maximum and minimum depending on content.

In contrast, the wallet 10*c* would typically tend to stand the front 22 and back 18 apart. This follows by virtue of the structure and stiffness of the material and the configuration of the seam 30 therein.

The wallet 10*e* relies on abutted edges between the back 18 and the side walls 16. Accordingly, a seam 30 may secure the back 18 to the side walls 16 in a very compact configuration. This is an alternative to the seams 30 on the front of the wallet 10*a*. This also puts bending stresses directly on the seam 30 when content 38 is maximized.

Similarly, the wallet 10*f* may have a seam 30 formed between the corresponding edges of the side walls 16*a*, 16*b* and the front 22. Again, a comparatively low profile and no additional thickness (from seams, etc.) are benefits of such an abutment of edges together. This also increases bending loads, however, on seams 30 when content is maximum.

The wallet 10*g* may rely on an abutment of edges of each of the side walls 16, with a seam 30 right at the outermost extremum of the width 28*b* of the wallet 10*g*. As a practical matter, this may create in the seam substantial stress at minimum content thickness.

In this respect, one advantage of the embodiment of the wallet 10*a* is the fact that the seam 30 is located in an area that does not see much flexing, and minimum deflection (movement, distortion) in any direction. On the other hand, the front 22 presents a surface that will typically be against the stressed or stretched fabric of a user's pocket.

It may therefore see a different type of wear, abrasion. This is caused by contact friction of relative movement, rather than the repeated stress (force per unit of area) and strain (stretch per unit of length, due to stress). These latter phenomena are associated with folding or bending that might be encountered in the seam 30 of the wallet 10*g* or others.

Figure 18:
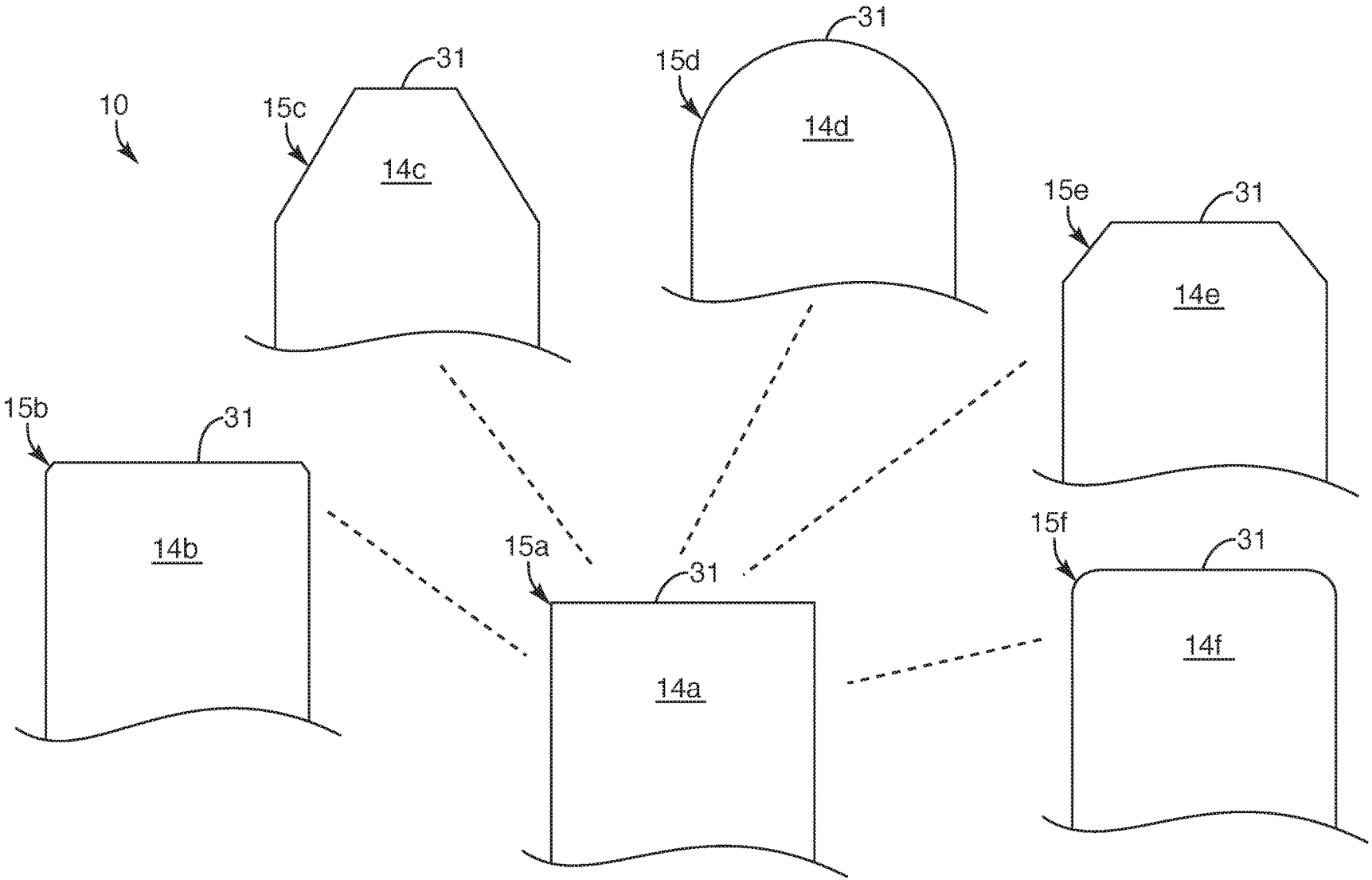
FIG. 18 is a front elevation view of various alternative embodiments of closures on a wallet in accordance with the invention.

Referring to FIG. 18, while continuing to refer generally to FIGS. 1 through 20, the closure 14 may be manufactured in any of several configurations 14*a*, 14*b*, 14*c*, 14*d*, 14*e*, 14*f*. For example, in certain materials, such as plastics, sometimes leather, seldom fabric, and so forth, the corners 15 may be made comparatively sharp, even at a sharp right angle. In other embodiments, the closure 14*b* may have a corner 15*a* that looks dog-eared, but is actually cut to that shape. The alteration (narrowing) of width 28*b* of the closure 14 at a corner 15*a* will tend to pilot the leading edge 31 into the opening 20 of the pocket 12.

Perhaps an extreme case of cutting off a corner 15 is illustrated in the closure 14*c*. The corner 15*a* has been cut to leave only a comparatively short leading edge 31. Such may easily pilot the closure 14*c* into the opening 20 of the pocket 12. In yet another alternative embodiment, the closure 14*d* includes a corner 15*d* at a radius that effectively takes on a semicircular shape. There is effectively no "corner," but rather the leading edge 31 progresses from the tangent at the center of a wall to the tangent at or near the side walls 16 of the closure 14*d*.

Of course, various alternative embodiments such as the corner 15*e* on the closure 14*e* capture an intermediate length of the leading edge 31 for piloting into the opening 20 of the pocket 12. The embodiment of the closure 14*f* provides a radiused corner 15*f* eliminating or certainly resisting snagging, bending over, catching, or other interference by the radiused corner 15*f*, as compared with the corner 15*a* of the closure 14*a*.

Again, the particular material of which the wallet 10 is formed will make a difference. For example, MYLAR™ brand plastic film may be used as a material for the wallet 10. The comparative stiffness, in spite of the comparative thinness, of the material would tolerate substantially any of the corners 15*a* through 15*f*. On the other hand, plastics, when excessively deformed or deflected may yield, and thus permanently bend and damage corners 15. One of the treatments corners 15*b* through 15*f* may still be preferable, even with a stiff material.

In certain embodiments, the wallet 10 may actually be molded of a polymeric material, such as an elastomeric polymer. Silicones, synthetic rubber, polyethylene, polypropylene, polyurethane, either solid or expanded (foamed), and the like may all be used. Meanwhile, more stiffness such as may be obtained with other choices of stiffer or flexible sheet polymers.

Polyethylene, polyurethane, polyvinylchloride, vinyl, nylon, silicone, and the like may be used as a base material (straight or foamed). Solid polymer or foamed polymer may be molded in a mold (e.g., injection molded, reaction injection molded, blow molded, vacuum formed, etc.). The wallet 10 may be made in a single piece not even requiring seams 30.

Nevertheless, urethane material, especially if foamed, may be formed in sheets which may likewise be sewn by seams 30 to be used similarly to leather. Heat seams 30 may be used with thermoplastics. Thermosets fully reacted are not re-melted when heated. Seams 30 may be adapted as needed for plastics or any other sheet material.

Figure 19:
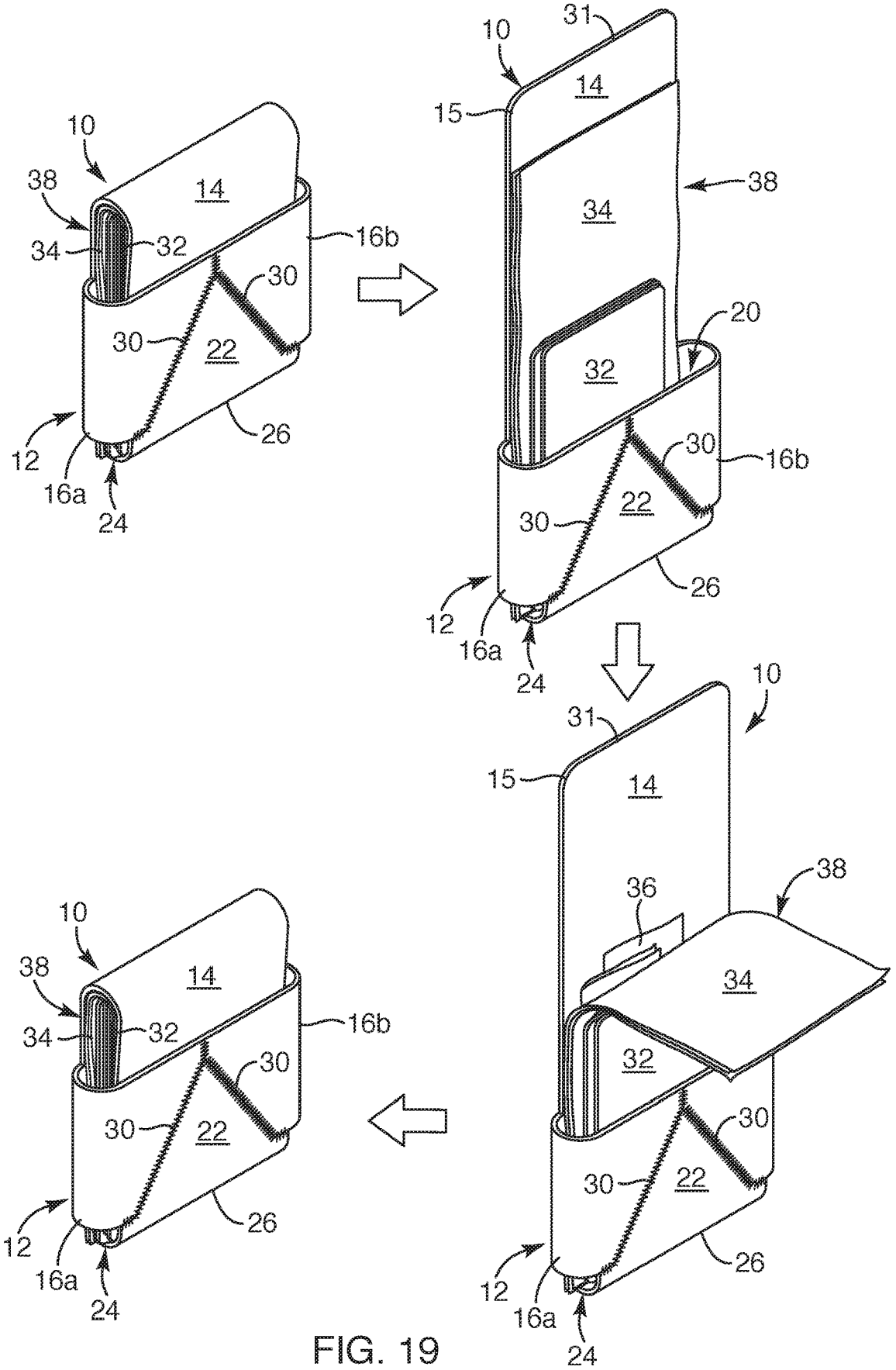
FIG. 19 is a perspective view of a wallet in accordance with the invention in a process of use including opening, extraction, replacement and closure.

Referring to FIG. 19, while continuing to refer generally to FIGS. 1 through 20, a wallet 10 may fit into a pocket 12 of an article of clothing or piece of luggage (e.g., backpack, duffle, briefcase, etc.) of a user. The content 38 may include, for example, credit cards 32 or other cards 32, paper money 34, also referred to as bills 34, and receipts 36. In operation, a wallet 10 in accordance with the invention may be withdrawn from a pocket by a user in a closed configuration as shown in the upper left corner of the illustration, with the content 38 all neatly contained.

By grasping the lateral edges of the closure 14 between a thumb and finger, or by sliding the closure upward out of the pocket 12 with a thumb, the closure 14 may be withdrawn from the opening 20 of the pocket 12 of the wallet 10. Thus, the wallet 10 is in the next configuration proceeding clockwise. A user may press down to rub a thumb against the closure 14 just above the front 22 of the wallet 10, with enough force to frictionally engage the content 28 therebehind.

This results in pushing the closure 14 up to an open position while also unfolding the contents 38. Accordingly, the credit cards 32, and bills 34 behind them, are revealed for access and use. A user may then flip through the bills 34, by pushing down on the face of each one with a thumb, thereby finding any bill 34 of a particular domination desired. Similarly, a user may fan the credit cards 32 to find the right one by color or design. One may slide one out by gripping with a thumb and fingertip. One may, or may simply slide, with a thumb or single finger, one or more of the cards 32 upward out of the pocket 12.

Following any transaction, a user may then re-insert the credit card 32, or any bills 34 received in change, into the pocket 12. Between the closure 14 and the bills 34, one may slide receipts 36 down against the back 18, into the pocket 12 between the bills 34 and the closure 14. Sliding receipts 36 between the closure 14 and the bills 34, is subject to friction from both. Alternatively, one may withdraw the contents, stack everything, and slide the entire compacted contents into the pocket. One may then fold the closure 14, thereby bending the sheaf of bills 34 toward the user, to tuck into the pocket 12. Regardless, all contents may be seen directly and withdrawn directly at any time by opening the closure 14.

Referring to FIG. 19 still, one will ultimately see, moving clockwise, the lower left configuration. The closure 14 may be folded over the receipt 36 and bills 34, with the bills 34 being folded over the cards 32. The closure 14 and bills 34 are tucked in against the cards 32, behind the front 22, sliding down into the pocket 12 to close the wallet 10. The thickness, stiffness, and piloting provided by the closure 14 press and hold the contents together while sliding downward against the front 22. Thus, closing is mechanically simple, with a simple accommodation of all forces acting in the system 10.

Thus, one sees how the content 38 may be opened, inserted, viewed, withdrawn, managed, closed, etc. When removing or inserting cards 32, bills 34, or receipts 36, the cards 32 provide dimensional stability to the bills 34. They also act to effectively clamp the bills 34 between the cards 32 and the back 18, as well as the cards 32 and the front 22 of the wallet 10. In this way, as seen as in the third configuration (starting from the upper left and moving clockwise), one sees that any particular subset of the content 38 is readily visible, separable, and accessible for placement or removal by a user.

Figure 20:
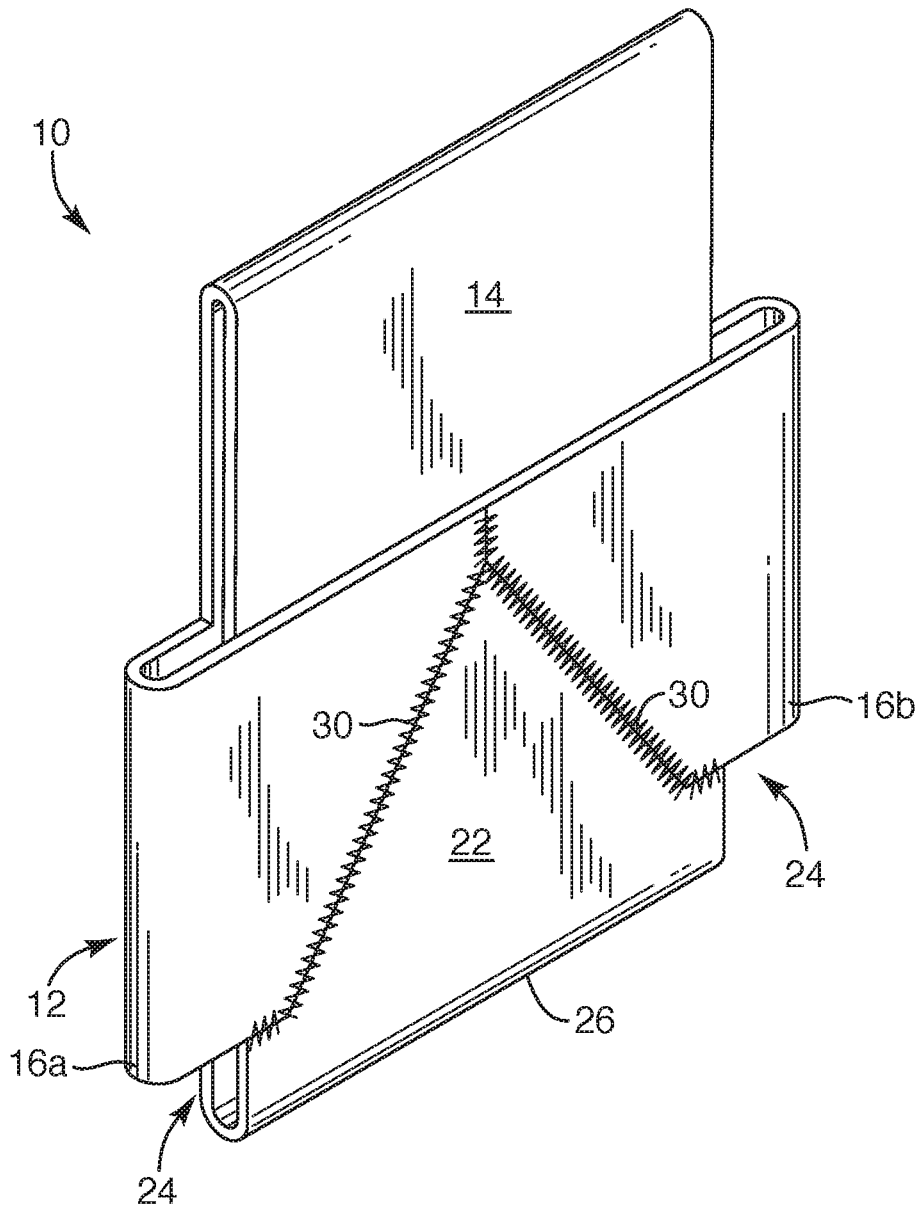
FIG. 20 is a perspective view of one embodiment of a wallet in accordance with the invention in a minimal thickness configuration, such as would occur with minimal content and therefore thickness.

Referring to FIG. 20, while continuing to refer generally to FIGS. 1 through 20, a wallet 10 in accordance with the invention may include a minimum content 38 or no content 38 at all. Thusly, it may be placed and carried in a pocket 12 of a user in a minimum-thickness 28*a* configuration. The sides 16 or side walls 16, by virtue of the relief 24 provided instead of secured corners 15, effectively eliminate, and certainly greatly reduce, resistance to collapse of the thickness 28*a*. The flexibility of the material of which the wallet 10 is made and its thickness at the vertical centerline of the pocket 12, play an important role. They may be selected (engineered) to permit the side walls 16 to be folded virtually flat against themselves when content 38 is minimized.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A wallet, comprising:

a blank cut as a single, flat sheet of material in a shape, pre-determined, planar, and accommodating panels and folds for the wallet constituted by a solitary pocket the panels being folded to establish a perimeter of the solitary pocket for the wallet;

the panels being bound together to form:

a front panel and a rear panel, spaced apart, a left panel and a right panel spaced apart and connecting the front panel to the rear panel, a closure panel extending contiguously from the rear panel and capable of folding forward from a rear panel and tucked behind the front panel, and a bottom panel extending contiguously from the rear panel; and a gap disposed between the left and right panels with respect to the bottom panel precluding direct securement therebetween by being empty of any material of the blank, the left, right, and bottom panels being abutted to one another to define the front panel.

2. The wallet of claim 1, wherein the closure panel is formed to include a pilot capable of piloting the closure panel between the left and right panels to tuck into the solitary pocket to substantially enclose a contents of the solitary pocket on six sides.

3. The wallet of claim 1, further comprising a spacing between the left and bottom panels and between the right and bottom panels, such that no contact exists across the spacing when the wallet contains contents.

4. The wallet of claim 3, further comprising a material for the left panel and the right panel sufficiently flexible to fold flat against itself proximate a center thereof when the contents are reduced in a cavity of the solitary pocket, and to form, with the front and rear panels, folded edges around the contents when the contents are increased.

5. The wallet of claim 1, further comprising a spacing between the left panel and the closure panel, between the left panel and the bottom panel, between the right panel and the closure panel, and between the right panel and the bottom panel, leaving the left, right, and bottom panels free to fold along the entire respective length of each.

6. The wallet of claim 1, wherein the closure panel has a leading edge capable of sliding behind the front panel, the leading edge being shaped to pilot the closure panel between the left and right sides.

7. The wallet of claim 1, wherein the solitary pocket has six sides constituted by the front, rear, left, right, bottom, and closure panels and only eight folded edges therebetween.

8. The wallet of claim 1, wherein the front panel is formed by abutting a left edge corresponding to the left panel against a bottom edge corresponding to the bottom panel, abutting a right edge corresponding to the right panel to a portion of the bottom edge.

9. The wallet of claim 1, wherein the solitary pocket is configured to receive bills, constituting legal tender, behind a card, stiffer than the bills, in a cavity of the solitary pocket.

10. The wallet of claim 1, wherein the left and right panels each define a semicircular opening, the bottom panel defines a semicircular opening.

11. The wallet of claim 1, wherein the left, right, and bottom panels are stitched to one another.

12. A wallet, comprising:

a single sheet of material including panels folded to establish a perimeter of a solitary pocket for the wallet, the panels including:

a front panel and a rear panel, a left panel and a right panel connecting the front panel to the rear panel, a closure panel extending contiguously from the rear panel and capable of folding forward from the rear panel and tucked behind the front panel, and a bottom panel extending contiguously from the rear panel; and a gap disposed between the left and right panels with respect to the bottom panel precluding direct securement therebetween by being empty of any material of the single sheet of material, the left, right, and bottom panels being abutted to define the front panel.

13. The wallet of claim 12, wherein the closure panel is formed to include a pilot capable of piloting the closure panel between the left and right panels to tuck into the solitary pocket to substantially enclose contents of the solitary pocket on six sides.

14. The wallet of claim 12, further comprising a spacing between the left and bottom panels and between the right and bottom panels, such that no contact exists across the spacing when the wallet contains contents.

15. The wallet of claim 14, further comprising a material for the left panel and the right panel sufficiently flexible to fold flat against itself proximate a center thereof when the contents are reduced in a cavity of the solitary pocket, and to form, with the front and rear panels, folded edges around the contents when the contents are increased.

16. The wallet of claim 12, further comprising:

a spacing between the left panel and the closure panel, between the left panel and the bottom panel, between the right panel and the closure panel, and between the right panel and the bottom panel, leaving the left, right, and bottom panels free to fold along the entire respective length of each.

17. The wallet of claim 12, wherein the closure panel has a leading edge capable of sliding behind the front panel, the leading edge being shaped to pilot the closure panel between left and right sides.

18. The wallet of claim 12, wherein the solitary pocket has six sides constituted by the front, rear, left, right, bottom, and closure panels and only eight folded edges therebetween.

19. The wallet of claim 12, wherein the front panel is formed by abutting a left edge corresponding to the left panel against a bottom edge corresponding to the bottom panel, abutting a right edge corresponding to the right panel to a portion of the bottom edge.

20. The wallet of claim 12, wherein the solitary pocket is configured to receive bills, constituting legal tender, behind a card, stiffer than the bills, in a cavity of the solitary pocket.

* * * * *